United States Patent [19]

Yamada

[11] Patent Number: 4,697,814

[45] Date of Patent: Oct. 6, 1987

[54] IRON CLUB HEAD

[75] Inventor: Magoichi Yamada, Saitama, Japan

[73] Assignee: Daiwa Golf Co., Ltd., Tokyo, Japan

[21] Appl. No.: 846,629

[22] Filed: Apr. 1, 1986

[30] Foreign Application Priority Data

Apr. 8, 1985 [JP] Japan ..... 60-51790[U]

[51] Int. Cl.[4] ..... A63B 53/04

[52] U.S. Cl. ..... 273/169; 273/78

[58] Field of Search ..... 273/174, 172, 169, 171, 273/173, 78, 167 A, 167 F, 167 J

[56] References Cited

U.S. PATENT DOCUMENTS 1,574,213 2/1926 Tyler ..... 273/174 X 2,332,342 10/1943 Reach ..... 273/174 X 4,479,652 10/1984 Nagamoto ..... 273/172

*Primary Examiner*—George J. Marlo

*Attorney, Agent, or Firm*—Kalish & Gilster

[57] ABSTRACT

An iron golf club head comprising a base metal body having a sole portion which latter is continuous with a hosel portion at the heel end of said sole portion. A weight setting block is provided spacedly above said base metal body and being supported in such position by a plurality of spaced apart support members. A vertical space is disposed between the weight setting block and the hosel portion. A step is formed on said base for receiving the base portion of a fiber-reinforced synthetic resin body encasingly covering said support member and thereby conducing to the security of said synthetic resin material in operative position. A fiber-reinforced synthetic resin layer is also provided on the outer surface of the hosel and at the outer surface of the weight setting block. The weight setting block support members may be of various configurations and of relative dimensions.

7 Claims, 9 Drawing Figures

IRON CLUB HEAD

BACKGROUND AND SUMMARY OF THE INVENTION

This invention concerns an iron club head and, more specifically, it relates to an iron club head in which at least the ball hitting region of the head main body is formed with fiber-reinforced synthetic resin material.

The iron club heads have generally been formed integrally from metal material such as soft iron or stainless steel in the shape and weight according to respective club number. However, since the club heads of this kind are in the form of a metal block, such are poor in resiliency, especially lacking in resiliency at the hitting face, which is most important for hitting a ball. The repellent coefficient is small and thus inadequate to obtain a soft feeling upon hitting, as in the case of a wood club, whereby the impact shock upon hitting is transmitted to the grip and with an unsatisfactory ball flight distance being obtained.

In view of the above, at least the face (hitting face) portion of the club head main body is formed with fiber-reinforced synthetic resin material incorporated with carbon fibers or the like thereby improving the repellent force at the hitting face and causing a soft feeling upon hitting a ball, as disclosed, for example, in Japanese Utility Model Laid-Open Publication No. 16670/1984 in which a metal main body comprising a plate-like core member erected, for example, about at the middle of a sole portion in continuity with the shaft inserting portion (hosel) in the longitudinal direction of the sole portion and an outer synthetic resin member is integrally molded to the main body; or as disclosed in Japanese Patent Utility Model Laid-Open Publication No. 190270/1984 in which a core portion substantially of a trigonal cross section protruding integrally from the sole portion at the lower end of a golf club head upwardly is made of metal, such as soft iron or stainless steel. A plurality of through holes penetrating the core portion in the forward and backward directions are provided and the fiber-reinforced synthetic resin mainly composed of carbon fibers is integrally covered to harden approximately in an inverted adversed V-shape at the front and rearward face of the core, while the fiber-reinforced synthetic resin is filled in in each of the holes.

However, although a plurality of perforations are disposed in each of the known examples, the main purpose thereof resides in enhancing the securement between the synthetic resin and the metal member but not in intending the enlargement for the sweet spot. Further, in the conventional club in which the entire head is made only with metal, since the hosel portion is in a long cylindrical shape so as to provide thick and effective joining area in view of the joining strength with the shaft and the weight is localized toward the heel side, it has been difficult to arrange the sweet spot at the center of the ball hitting region. Moreover, in those clubs of the type in the foregoing two citations in which the ball hitting region is covered with a synthetic resin of a low specific gravity, the sweet spot is further localized toward the heel side and the sweet spot is missed even when the ball is hit at the appropriate central position of the hitting face, thereby reducing the ball flight distance.

This invention has been made in order to overcome the foregoing problems in the prior art and one object thereof is to properly disperse the weight of the ball hitting region in all directions, thereby makng the sweet spot position appropriate and enlarging the sweet spot through the spaces between the sole and hosel portions and the ball hitting region which is thickest in the metal body.

Another object of this invention is to provide an iron club head capable of facilitating the shaping of the ball hitting region made of synthetic resin and weight setting and having high joining strength, without reducing the repellent force and the feeling upon hitting the ball.

DESCRIPTION OF THE PRACTICAL EMBODIMENTS

Figure 1:
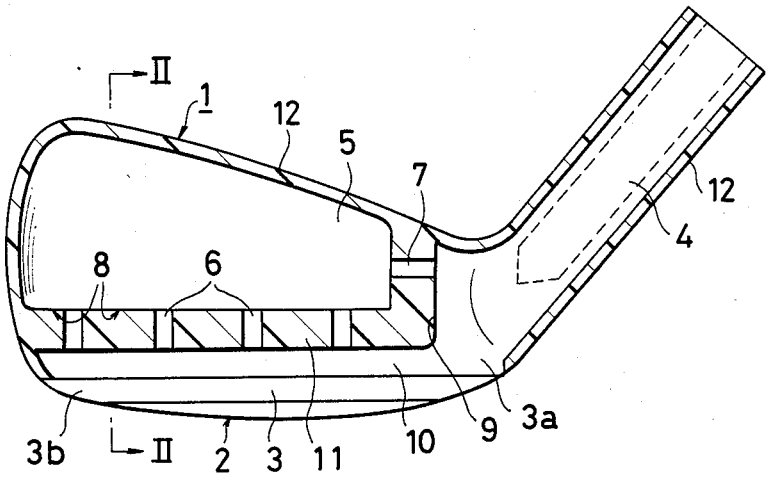
FIG. 1 is a front elevational view in partial section of an iron club head constructed in accordance with and embodying the invention.

Referring now by reference characters to the drawings which illustrate practical embodiments, the present invention will now be described.

Figure 2:
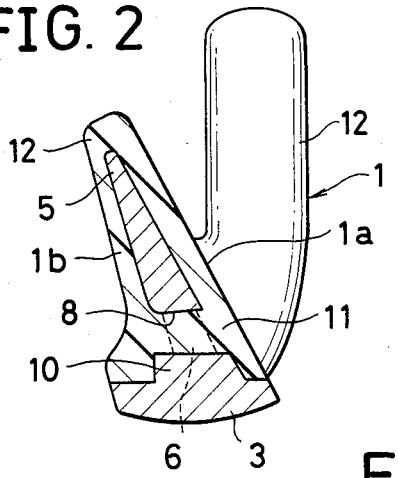
FIG. 2 is a transverse sectional view taken along line II—II.
Figure 3:
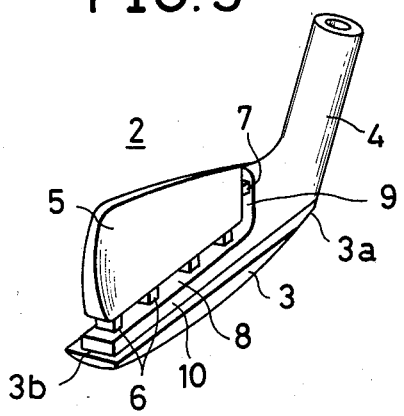
FIG. 3 is a perspective view of the base metal body of the club shown in FIG. 1.

FIGS. 1 through 3 illustrate a first embodiment of an iron club head according to the present invention, in which an iron golf club head is generally designated by reference numeral 1 having a base metal body 2 integrally formed from metal, such as soft iron or stainless steel. As shown in FIG. 3, the base metal body 2 comprises a sole portion 3, a hosel portion 4 for shaft mounting integrally, and continuous, with the side of a heel 3*a*, there being a weight setting block 5 for establishing the weight of the entire club head 1 in accordance with the particular number of the club. The said block 5 is integrally connected with metal body 2 by means of a plurality of erect, i.e., vertical, support members 6 and a horizontal support member 7 while disposing the developed spaces or voids 8 and 9 above metal body 2 which is composed of the sole portion 3 and the hosel portion 4.

Spaces 8 are formed longitudinally above sole portion 3, while space 9 is formed vertically ahead of heel portion 3*a* and in continuity with spaces 8. Further a step 10 is formed longitudinally of sole portion 3 at the upper surface thereof for maintaining the mechanical coupling strength between the fiber-reinforced synthetic resin body 11 and sole portion 3 described later, the support members 6 bridging step 10 and weight setting block 5.

The thus constituted base metal body 2 is set into a head molding die (not illustrated) and, through compression molding or injection and solidification, fiber-reinforced synthetic resin material having reinforcing fibers, such as of carbon or glass fibers, on the inside of the molding die is provided and is integrally formed at the upper surface of the sole portion 3 (including the step 10) except for the lower surface and the spaces 8, 9 and a fiber-reinforced synthetic resin layer 12 is formed at the outer surface of the weight setting block 5.

In the iron club head 1 having thus been constituted, since the spaces 8 are disposed longitudinally of the sole portion 3 which is an increased thickness portion of the base metal 2 and the fiber-reinforced synthetic resin member 11 with a low specific gravity is filled into the spaces 8, the weight of the ball hitting area can be dispersed vertically to extend to a so-called sweet spot. Furthermore, since the vertical space 9 is disposed at the increased thickness portion between the weight setting block 5 and the hosel portion 4 and the fiber-reinforced synthetic resin material 11 is received in spaces 9, the weight on the side of the heel 3*a* can be transferred toward the toe 3*b* and, accordingly, the sweet spot can be transferred toward the toe 3*b* and, accordingly, the sweet spot can be presented at an appropriate position at the center of the face 1*a*. Further, since the weight setting block 5 is disposed, the weight required for the iron club head can be determined with ease by varying the shape, the thickness, etc., of the block and, in addition, since the block 5 is integrally formed with the base metal body 2 by means of the support members 6, 7. The base metal body 2 including the weight setting block 5 can be molded with ease to improve the productivity thereof and, thus, the productivity of the iron club head with the composite structure of the fiber-reinforced synthetic resin material 11 can be improved. In addition, since the weight setting block 5 has the function of supporting the fiber-reinforced synthetic resin material 11 onto the base metal body 2, defoliation between the base metal 2 and the fiber-reinforced synthetic resin member 11 and the fiber-reinforced synthetic resin layer 12 caused by the impact upon shooting can be prevented. Further, since the support members 6, 7, disposed integrally between the weight setting block 5 and the step 10 and between the weight setting block 5 and the hosel portion 4, respectively, are made transversely thinner at the portions where they are joined than the transverse width for the weight setting block 5 and the step 10, the area of contact with the fiber-reinforced synthetic resin material 11 within spaces 8 and 9 can be increased to enhance the coupling strength.

In addition, since the ball hitting region of the club head is formed with the fiber-reinforced synthetic resin material 11 and the fiber-reinforced synthetic resin material 11 and the fiber-reinforced synthetic resin layer 12, the repellent force is enhanced to increase the ball flight distance as compared with a metal club head, as well as the impact shock upon shooting being moderated, without transmitting through the base metal body 2 to the grip, making it possible to obtain an iron club head with a comfortable feeling upon shooting.

Furthermore, the hitting position upon hitting the ball is formed with the fiber-reinforced synthetic resin material 11 in the ball hitting region mainly formed with the longitudinal spaces 8, and since the weight setting block 5 and the step 10 are situated at the periphery thereof, the ball flight distance can be extended as compared with the ball hitting region formed only with the fiber-reinforced synthetic resin material 11. Accordingly, in the case of a long iron intended to attain a greater flight distance, the longitudinal length of the spaces 8 is decreased. While on the other hand, in a short iron requiring ball control, the longitudinal width of spaces 8 is increased so as to permit easily the application of spinning to the ball by virtue of the fiber-reinforced synthetic resin material 11. Since the longitudinal spaces 8 provide an effect on the ball flight distance and ball control, as well as on the entire weight, a relative enlargement of such spaces will cause the flight distance to be relatively decreased since the entire weight becomes insufficient.

Furthermore, it is also possible to produce a club so as to obtain easily a flight distance by relatively decreasing the longitudinal extent of the spaces 8 for beginners and middle class players as compared with those for skilled players with respect to the same number of club. In this way, even beginners and middle class players can use those clubs with the same appearance and shape of those for the skilled player by virtue of merely changing the internal structure while causing no effect on the exterior appearance. Particularly, since beginners and middle class players rather tend to prefer the use of the same clubs as those for the skilled players, their needs can thus be satisfied.

Figure 4:
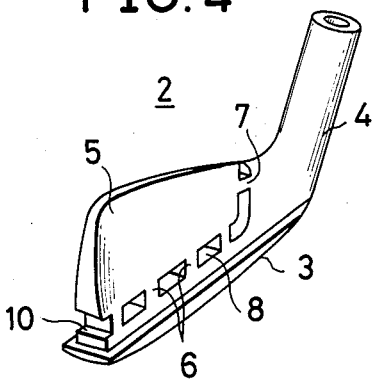
FIG. 4 is a perspective view of the base metal body of another form of iron club constructed in accordance with and embodying the present invention.

FIG. 4 shows another embodiment of the base metal body 2 of this invention, in which support members 6 and 7 are made coplanar, and integral, with weight setting block 5. The same effects and objects as those obtained in the embodiment described above can also be obtained in this embodiment.

Figure 5:
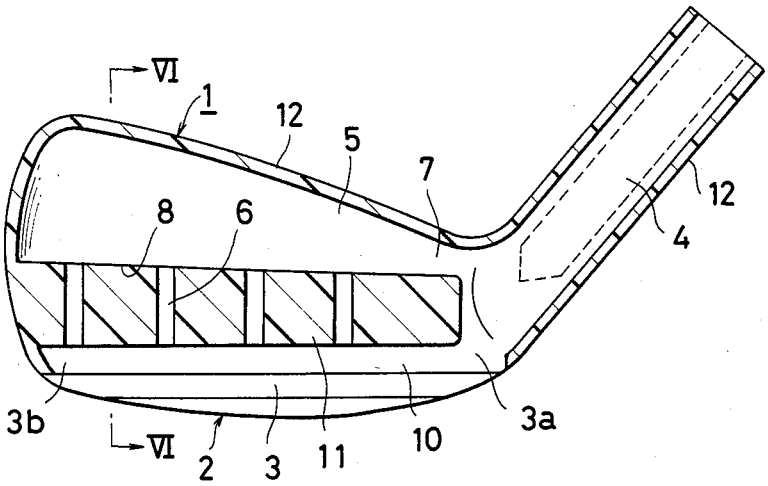
FIG. 5 is a front elevational view in partial section of a further form of iron club head constructed in accordance with and embodying the present invention.
Figure 6:
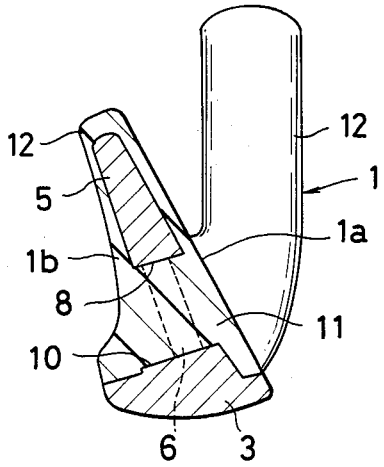
FIG. 6 is a transverse sectional view taken along line VI—VI in FIG. 5.
Figure 7:
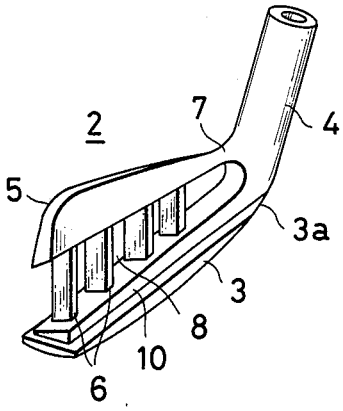
FIG. 7 is a perspective view of a base metal body of the iron club head illustrated in FIG. 5.

FIGS. 5 through 7 show a further embodiment of this invention, in which support members 6 are made relatively longer and the position of support member 7 is made coplanar and integral with weight setting block 5. According to this embodiment, since the region occupied by the fiber-reinforced synthetic resin material 11 is relatively broad, enlargement of the sweet spot can be attained more effectively as compared with the embodiment described above.

Figure 8:
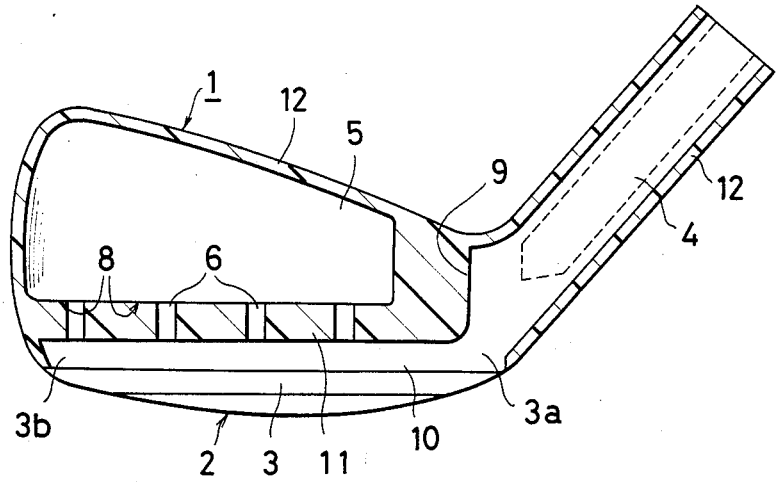
FIG. 8 is a front elevational view in partial section of a still further form of iron club head constructed in accordance with and embodying the present invention.

FIG. 8 shows a still further embodiment according to this invention, in which a support member 7 as shown in FIG. 1 is eliminated. In this form of the invention, metal materials at the hosel portion 4 and heel portion 3*a* are removed over a relatively wider range, by which the entire weight can be localized toward the top end of sole portion 3, whereby the inertia movement upon swinging the club is increased which is desirable in the case of a long or higher number iron. In such embodiment, it is preferred that base metal body 2 be made of relatively strong material.

Further, in the case of constituting the iron club head as shown in FIG. 8 with usual material, the width of support members 6 may be relatively enlarged to increase strength. In this way, the possibility of deforming the club head upon shock of ball impact can be avoided without support member 7.

Figure 9:
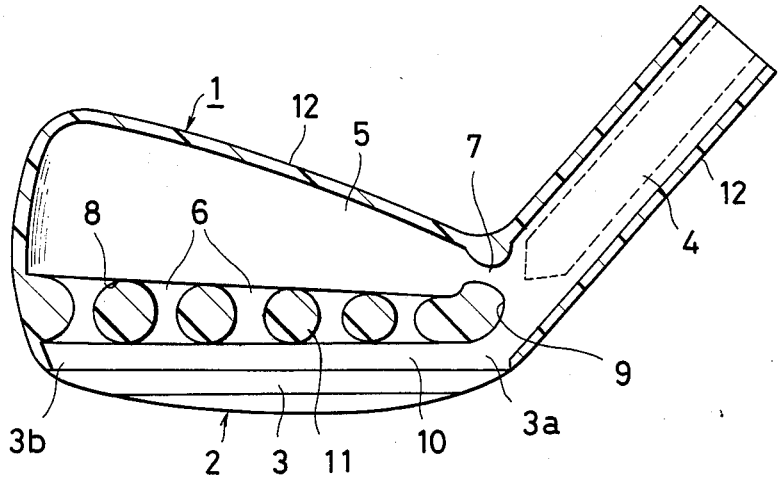
FIG. 9 is a front elevational view in partial section of a further form of iron club head constructed in accordance with and embodying the present invention.

FIG. 9 shows a yet further embodiment according to this invention in which spaces 8 and 9 defined by the support members 6, 7 are in the form of circular or oval holes and with the contour of support members 6, 7 being complementarily configured.

In this case, in view of the nature of the joining portion between each of the support members 6 and weight setting block 5 and the step 10, as well as of the joining portion between support member 7 and weight setting block 5, hosel portion 4 and sole portion 3*a* are in an R-shaped configuration to improve the supporting strength of weight setting block 5 and function as the support upon deformation of the weight setting block 5 by the impact shock upon shooting.

Although explanation has been made in each of the foregoing embodiments for the case of forming the longitudinal space 8 substantially in parallel with the sole portion 3, toe side 3*b* may be made higher and the heel side 3*a* may be made lower relative to the sole surface. In this case, since the weight is localized to the top end of sole portion 3 which is at the longest distance from the grip of the shaft in connection with hosel portion 4, the club having such an iron club head possesses an increased inertia movement upon swinging and thus is suitable for a long iron.

Furthermore, weight setting block 5 is not necessarily restricted to an integral piece as shown in each of the foregoing embodimetns but it may have a structure comprised of two or more interrelated sections in the toe-heel direction of the club head.

The foregoing explanations are made only for illustrating the embodiments according to this invention and it is, of course, possible to optionally alter the design within a range not departing from the technical range as described in the claims.

What is claimed is:

1. An iron golf club head comprising a base metal body having a sole portion, there being a hosel portion continuous with said sole portion along the longitudinal direction thereof, a plurality of spaced support members provided on said base metal body, a weight setting block supported by said support members in elevated relation to said sole portion, a fiber-reinforced synthetic resin member encasingly covering the weight setting block and a layer of fiber-reinforced resin synthetic material provided on the outer surface of said covered weight setting block, there being a vertical space disposed between the weight setting block and the hosel portion of the base metal body, the support members defining a plurality of spaces between them through which extend fiber-reinforced synthetic material defining said fiber reinforced synthetic resin member.

2. The iron club head as defined in claim 1, wherein said support members are vertical and the weight setting block is continuous with the base metal body and is joined thereto by means of said vertical support members.

3. The iron club head as defined in claim 1, wherein the weight setting block is continuous with the base metal body and is joined thereto by means of said plurality of support members, said support members being constituted by a plurality of vertical surpport members and a lateral support member.

4. The iron club head as defined in claim 1 wherein the support members have a transverse thickness which is less than a transverse width of the weight setting block where supported by said support members.

5. The iron club head as defined in claim 1 wherein said sole portion includes a step formed longitudinally thereon, said support members bridging said step and said weight setting block.

6. The iron club head as defined in claim 1 wherein said spaces are rectangular.

7. The iron club head as defined in claim 1 wherein said spaces are circular.

* * * * *